US012612279B2

(12) United States Patent
Hatada

(10) Patent No.: US 12,612,279 B2
(45) Date of Patent: Apr. 28, 2026

(54) PRINTING APPARATUS AND CONVEYANCE CONTROL METHOD

(71) Applicant: SEIKO EPSON CORPORATION, Tokyo (JP)

(72) Inventor: Kenji Hatada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 420 days.

(21) Appl. No.: 18/170,047

(22) Filed: Feb. 16, 2023

(65) Prior Publication Data

US 2023/0264914 A1 Aug. 24, 2023

(30) Foreign Application Priority Data

Feb. 18, 2022 (JP) ..... 2022-023581

(51) Int. Cl.

| | |
|---|---|
| ***B65H 23/18*** | (2006.01) |
| ***B65H 16/00*** | (2006.01) |
| ***B65H 20/02*** | (2006.01) |
| ***B65H 23/34*** | (2006.01) |
| ***B65H 26/02*** | (2006.01) |

(52) U.S. Cl.

CPC ..... *B65H 20/02* (2013.01); *B65H 16/00* (2013.01); *B65H 23/18* (2013.01); *B65H 23/34* (2013.01); *B65H 26/02* (2013.01); *B65H 2301/4493* (2013.01); *B65H 2403/41* (2013.01); *B65H 2404/144* (2013.01); *B65H 2404/1441* (2013.01); *B65H 2511/224* (2013.01); *B65H 2513/512* (2013.01); *B65H 2801/03* (2013.01); *B65H 2801/12* (2013.01)

(58) Field of Classification Search

CPC ..... B65H 20/02; B65H 16/00; B65H 26/02; B65H 2404/1441; B65H 2513/512; B65H 2801/03; B65H 2301/4493; B65H 2403/41; B65H 2404/144; B65H 2511/224; B65H 2801/12; B65H 23/18; B65H 23/34

See application file for complete search history.

(56) References Cited

U.S. PATENT DOCUMENTS 6,343,787 B1 * 2/2002 Kato ..... B65H 5/064 271/274

FOREIGN PATENT DOCUMENTS

JP 2008302536 12/2008
JP 2020158292 A * 10/2020 ..... B65H 23/188

* cited by examiner

*Primary Examiner* — Yaovi M Ameh
(74) *Attorney, Agent, or Firm* — WORKMAN NYDEGGER

(57) ABSTRACT

A conveyance unit includes a feeding unit that feeds a medium from a roll, a conveyance roller pair that conveys the medium toward a printing unit, an intermediate roller pair that conveys, toward the conveyance roller pair, the medium fed by the feeding unit, a first driving unit that rotates a first driving roller, and a load changing unit that changes a pressing load acting between a second driving roller and a second driven roller. A control unit can execute a first control that controls the load changing unit such that the pressing load is a first pressing load when the first driving roller is rotated in an intermittent conveyance, and execute a second control that controls the load changing unit such that the pressing load is not generated when the rotation of the first driving roller is stopped in the intermittent conveyance.

16 Claims, 8 Drawing Sheets

PRINTING APPARATUS AND CONVEYANCE CONTROL METHOD

The present application is based on, and claims priority from JP Application Serial Number 2022-023581, filed Feb. 18, 2022, the disclosure of which is hereby incorporated by reference herein in its entirety.

BACKGROUND

1. Technical Field

The present disclosure relates to a printing apparatus and a conveyance control method.

2. Related Art

The printing apparatus disclosed in JP-A-2020-158292 includes a printing unit that performs printing on a medium and a conveyance unit that conveys the medium to the printing unit. The conveyance unit includes a feeding unit that feeds the medium from a roll composed of the rolled medium, a conveyance roller pair, and an intermediate roller pair. The conveyance roller pair conveys, toward the printing unit, the medium fed by the feeding unit. The intermediate roller pair conveys, toward the conveyance roller pair, the medium fed by the feeding unit at a position between the feeding unit and the conveyance roller pair.

When the printing unit repeatedly performs the printing to the medium, positional displacement of the medium due to the printing may be increased and wrinkles may be formed in the medium during conveyance. When wrinkles are formed in the medium, wrinkles may be formed in the vicinity of the conveyance area of the intermediate roller pair in the medium, for example. When wrinkles are formed in the medium, the accuracy of the printing to the medium at the printing unit may be reduced, and therefore it is desirable to eliminate the wrinkles formed in the medium.

SUMMARY

A printing apparatus for solving the above-described problems includes a printing unit configured to perform printing on a medium, a conveyance unit configured to convey the medium to the printing unit, and a control unit configured to control the conveyance unit, wherein the conveyance unit includes a feeding unit configured to feed the medium from a roll wound with the medium in a rolled form, a conveyance roller pair configured to convey, toward the printing unit, the medium fed by the feeding unit, and an intermediate roller pair configured to convey, toward the conveyance roller pair, the medium fed by the feeding unit at a position between the feeding unit and the conveyance roller pair, the conveyance roller pair includes a first driving roller and a first driven roller configured to sandwich the medium together with the first driving roller, the intermediate roller pair includes a second driving roller and a second driven roller configured to sandwich the medium together with the second driving roller, the conveyance unit includes a first driving unit configured to rotate the first driving roller and a load changing unit configured to change a pressing load acting between the second driving roller and the second driven roller, and the control unit is configured to control the first driving unit such that the first driving roller is rotated and stopped in an alternate manner in an intermittent conveyance of conveying and stopping the medium in an alternate manner, execute a first control configured to control the load changing unit such that the pressing load is a first pressing load when the first driving roller is rotated in the intermittent conveyance, and execute a second control configured to control the load changing unit such that the pressing load is not generated or that the pressing load is a second pressing load smaller than the first pressing load when rotation of the first driving roller is stopped in the intermittent conveyance.

A conveyance control method for solving the above-described problems is a conveyance control method of conveying a medium with a conveyance unit, the conveyance unit including a feeding unit configured to feed the medium from a roll wound with the medium in a rolled form, a conveyance roller pair configured to convey the medium fed by the feeding unit, and an intermediate roller pair configured to convey, toward the conveyance roller pair, the medium fed by the feeding unit at a position between the feeding unit and the conveyance roller pair, the conveyance roller pair including a first driving roller and a first driven roller configured to sandwich the medium together with the first driving roller, the intermediate roller pair including a second driving roller and a second driven roller configured to sandwich the medium together with the second driving roller, the conveyance unit including a first driving unit configured to rotate the first driving roller and a load changing unit configured to change a pressing load acting between the second driving roller and the second driven roller, the method including controlling the first driving unit such that the first driving roller is rotated and stopped in an alternate manner in an intermittent conveyance of conveying and stopping the medium in an alternate manner, executing a first control configured to control the load changing unit such that the pressing load is a first pressing load when the first driving roller is rotated in the intermittent conveyance, and executing a second control configured to control the load changing unit such that the pressing load is not generated or such that the pressing load is a second pressing load smaller than the first pressing load when rotation of the first driving roller is stopped in the intermittent conveyance.

DESCRIPTION OF EXEMPLARY EMBODIMENTS

First Embodiment

Figure 1:
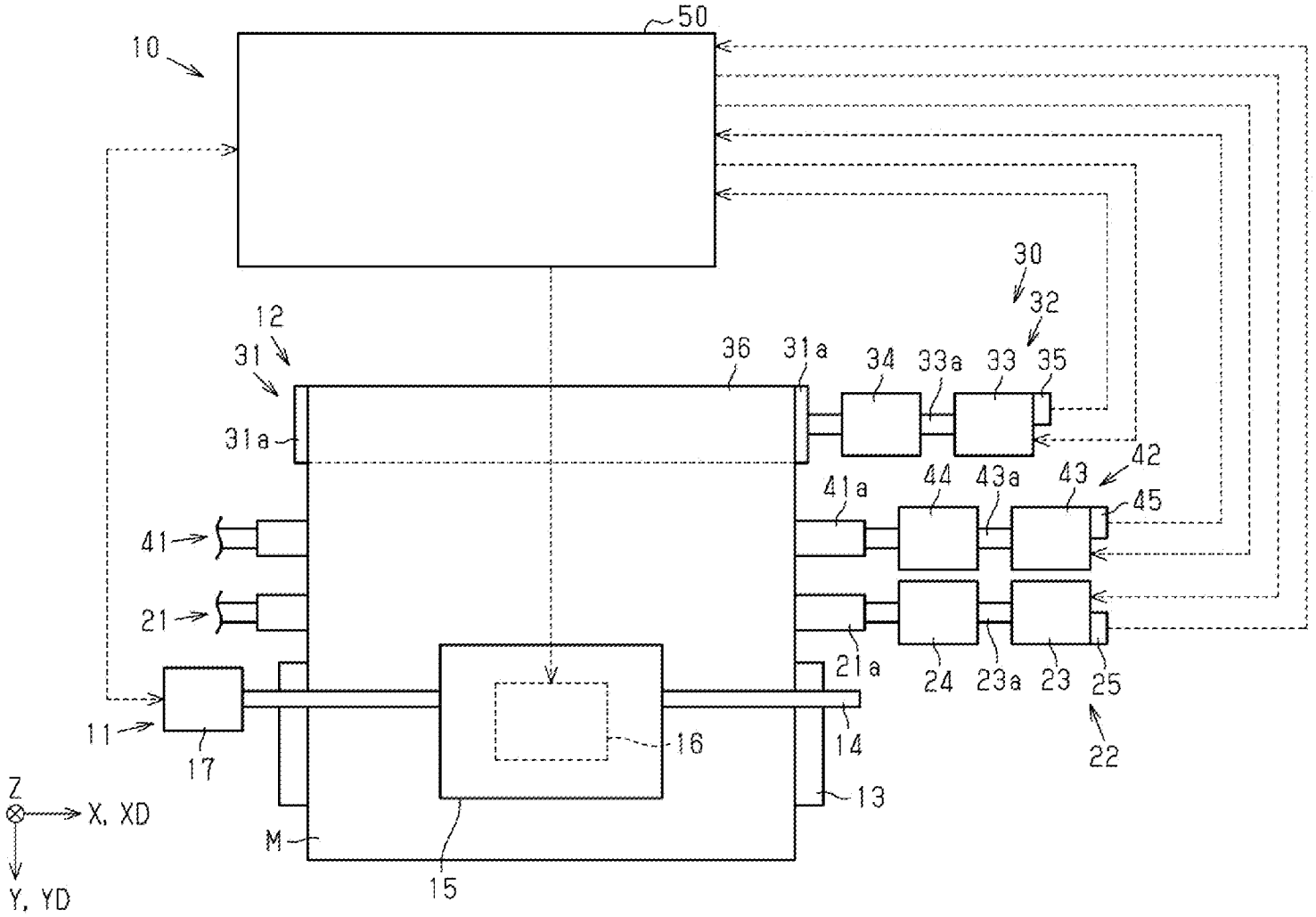
FIG. 1 is a schematic view illustrating a printing apparatus according to an embodiment.

A printing apparatus and a conveyance control method according to a first embodiment are described below with reference to the accompanying drawings. The printing apparatus is an ink-jet printer that performs printing by ejecting ink, which is an example of liquid, to a medium such as a sheet, fabric, vinyl, a plastic material, and a metal material, for example. The printing apparatus is a large format printer, for example. The large format printer is a printer that can perform printing on a medium with a size of A3-short width (297 mm) or larger.

In the drawing, the gravity direction is indicated as the Z axis, and the direction along the horizontal plane is indicated as the X axis and the Y axis on the assumption that the printing apparatus is placed on a horizontal plane. The X axis, the Y axis, and the Z axis are orthogonal to each other. The direction parallel to the X axis is also referred to as width direction X.

Printing Apparatus

As illustrated in FIG. 1, a printing apparatus 10 includes a printing unit 11 that performs printing on a medium M, and a conveyance unit 12 that conveys the medium M to the printing unit 11. In the printing apparatus 10, a printing operation of the printing unit 11 and a conveyance operation of the conveyance unit 12 are alternately performed. The printing apparatus 10 may include a support base 13. The support base 13 extends in the width direction X. The support base 13 supports the medium M in a printing region where printing is performed on the medium M by the printing unit 11.

The printing unit 11 may include a guide shaft 14, a carriage 15, a printing head 16, and a carriage driving mechanism 17. The guide shaft 14 extends in the width direction X on the upper side of the support base 13. The guide shaft 14 supports the carriage 15 so as to allow for movement along the guide shaft 14.

The printing head 16 is mounted in the carriage 15. The printing head 16 performs printing on the medium M by ejecting liquid to the medium M supported by the support base 13. The carriage driving mechanism 17 is a mechanism that moves the carriage 15 in a scanning direction XD. The printing unit 11 performs printing operation by ejecting liquid from the printing head 16 while moving the carriage 15 in the scanning direction XD along the guide shaft 14 with the carriage driving mechanism 17. The scanning direction XD may be parallel to the X axis direction. As described above, the printing unit 11 is of a serial type, but may be of a line type, for example.

Conveyance Roller Pair

Figure 2:
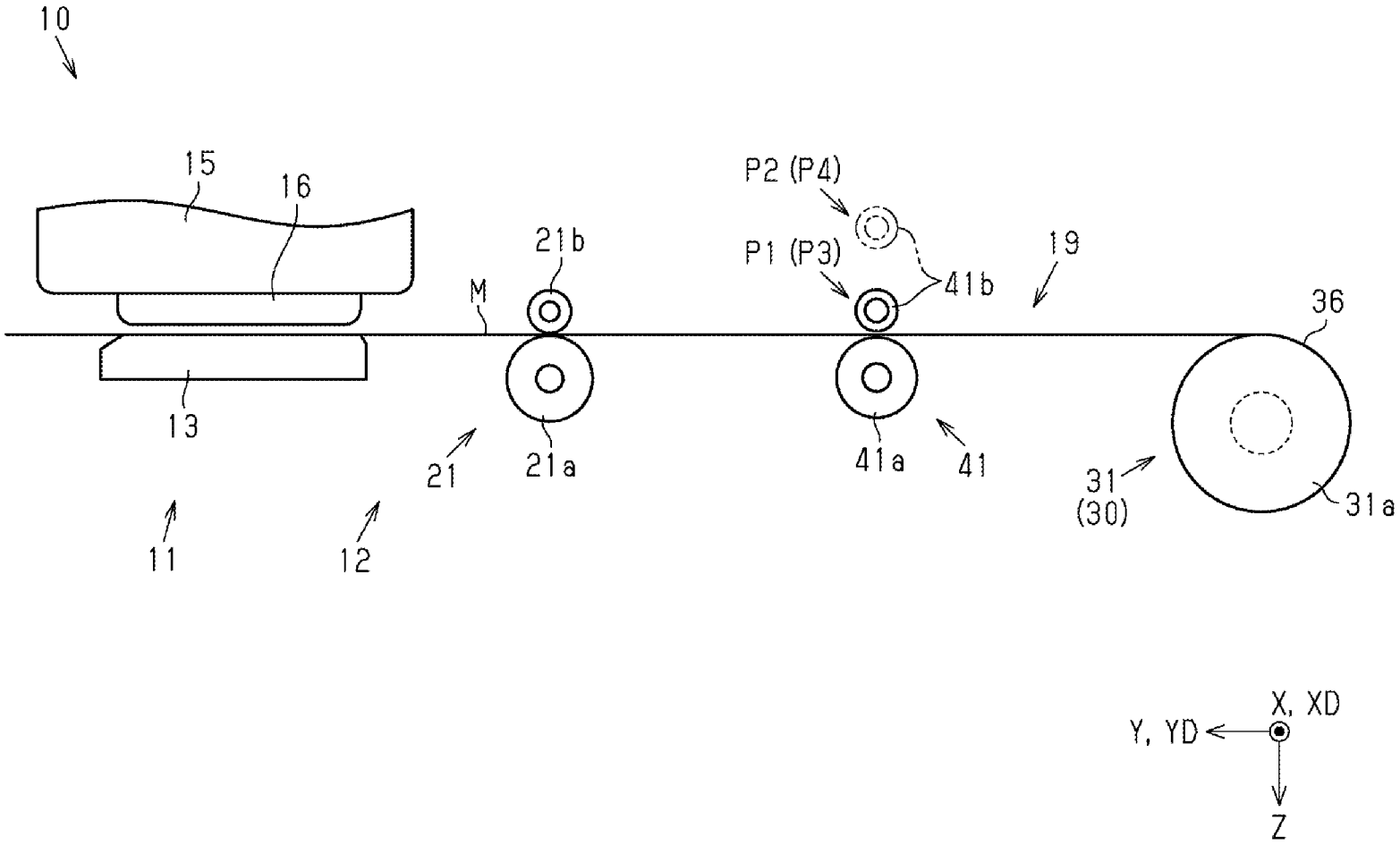
FIG. 2 is a schematic view illustrating a positional relationship among a roll, an intermediate roller pair, a conveyance roller pair, and a printing head.

As illustrated in FIG. 2, the conveyance unit 12 includes a conveyance roller pair 21 that conveys the medium M to the printing unit 11. The conveyance roller pair 21 includes a first driving roller 21*a* and a first driven roller 21*b*. The first driven roller 21*b* sandwiches the medium M together with the first driving roller 21*a*.

The first driven roller 21*b* rotates along with the rotation of the first driving roller 21*a*. The conveyance roller pair 21 is a nip roller. Each of the first driving roller 21*a* and the first driven roller 21*b* can rotate around the rotation shaft extending in the width direction X. Each of the first driving roller 21*a* and the first driven roller 21*b* may have a columnar shape extending in the width direction X. The conveyance roller pair 21 may include one first driving roller 21*a* and one first driven roller 21*b*.

First Driving Unit

As illustrated in FIG. 1, the conveyance unit 12 includes a first driving unit 22 that rotates the first driving roller 21*a*. When the first driving unit 22 drives the first driving roller 21*a* into rotation, the conveyance roller pair 21 conveys the medium M in a conveyance direction YD. The conveyance direction YD is the longitudinal direction of the medium M. The conveyance direction YD may be a direction parallel to the Y axis.

The first driving unit 22 may include a conveyance motor 23, a conveyance transmission mechanism 24, and a conveyance rotation detection unit 25. The conveyance motor 23 is a DC motor, for example. The conveyance motor 23 generates a conveyance driving torque for driving the first driving roller 21*a* into rotation.

The conveyance transmission mechanism 24 transmits the conveyance driving torque generated by the conveyance motor 23 to the first driving roller 21*a* at a predetermined reduction ratio. The first driving roller 21*a* rotates when the conveyance driving torque is transmitted from the conveyance transmission mechanism 24.

When the conveyance motor 23 is driven into forward rotation, the conveyance roller pair 21 rotates in the forward rotation direction. By rotating in the forward rotation direction, the conveyance roller pair 21 can convey the medium M in the conveyance direction YD toward the support base 13. The printing unit 11 performs printing on the medium M sent out from the conveyance roller pair 21. When the conveyance motor 23 is driven into reverse rotation, the conveyance roller pair 21 rotates in the reverse rotation direction. By rotating in the reverse rotation direction, the conveyance roller pair 21 can convey the medium M in the direction opposite to the conveyance direction YD.

The conveyance rotation detection unit 25 detects the rotational position and rotational direction of a conveyance output shaft 23*a* of the conveyance motor 23. The conveyance rotation detection unit 25 is a rotary encoder composed of a photo-interrupter and a scale with a disk shape provided at the conveyance output shaft 23*a* of the conveyance motor 23, for example.

Feeding Unit

As illustrated in FIG. 2, the conveyance unit 12 includes a feeding unit 30 that feeds the medium M from a roll 36. The roll 36 is wound with the medium M in a rolled form. The feeding unit 30 is disposed upstream of the conveyance roller pair 21 in the conveyance direction YD in a conveyance path 19 of the medium M.

As illustrated in FIG. 1, the feeding unit 30 may include a roll holding unit 31 and a roll driving unit 32. The roll holding unit 31 holds the roll 36 such that the roll 36 can rotate around the rotation shaft extending in the width direction X. The roll holding unit 31 includes a holder 31*a* that holds an end portion of the roll 36. The holder 31*a* may be located one at both end portions of the roll 36 in the width direction X. The holder 31*a* includes a rotation shaft part extending in the width direction X. The rotation shaft part is inserted in a core member of the roll 36.

The roll driving unit 32 includes a roll motor 33, a roll transmission mechanism 34, and a roll rotation detection unit 35. The roll motor 33 is a DC motor, for example. The roll motor 33 generates a roll driving torque for driving the roll 36 into rotation.

The feeding unit 30 may be attachable and detachable to and from the printing apparatus 10. More specifically, the roll motor 33 of the feeding unit 30 may be electrically couplable to a control unit 50 described later with a cable and the like.

The roll transmission mechanism 34 transmits the roll driving torque generated by the roll motor 33 to the roll holding unit 31 at a predetermined reduction ratio. When the roll driving torque is transmitted from the roll transmission mechanism 34 to the holder 31*a*, the holder 31*a* rotates. Along with the rotation of the holder 31*a*, the roll 36 rotates.

When the roll motor 33 is driven into forward rotation, the roll holding unit 31 rotates in the forward rotation direction. By rotating in the forward rotation direction, the roll holding unit 31 can feed the medium M from the roll 36 toward the conveyance roller pair 21. The conveyance roller pair 21 conveys, toward the printing unit 11, the medium M fed by the feeding unit 30. When the roll motor 33 is driven into reverse rotation, the roll holding unit 31 rotates in the reverse rotation direction. By rotating in the reverse rotation direction, the roll holding unit 31 can wind the medium M around the roll 36.

The roll rotation detection unit 35 detects the rotational position and rotational direction of a roll output shaft 33*a* of the roll motor 33. The roll rotation detection unit 35 is a rotary encoder composed of a photo-interrupter and a scale with a disk shape provided at the roll output shaft 33*a*, for example.

Intermediate Roller Pair

As illustrated in FIG. 2, the conveyance unit 12 includes an intermediate roller pair 41. The intermediate roller pair 41 conveys, toward the conveyance roller pair 21, the medium M fed by the feeding unit 30 at a position between the feeding unit 30 and the conveyance roller pair 21. The intermediate roller pair 41 includes a second driving roller 41*a* and a second driven roller 41*b*. The second driven roller 41*b* sandwiches the medium M together with the second driving roller 41*a*. The second driven roller 41*b* rotates along with the rotation of the second driving roller 41*a*. The intermediate roller pair 41 is a nip roller.

Figure 3:
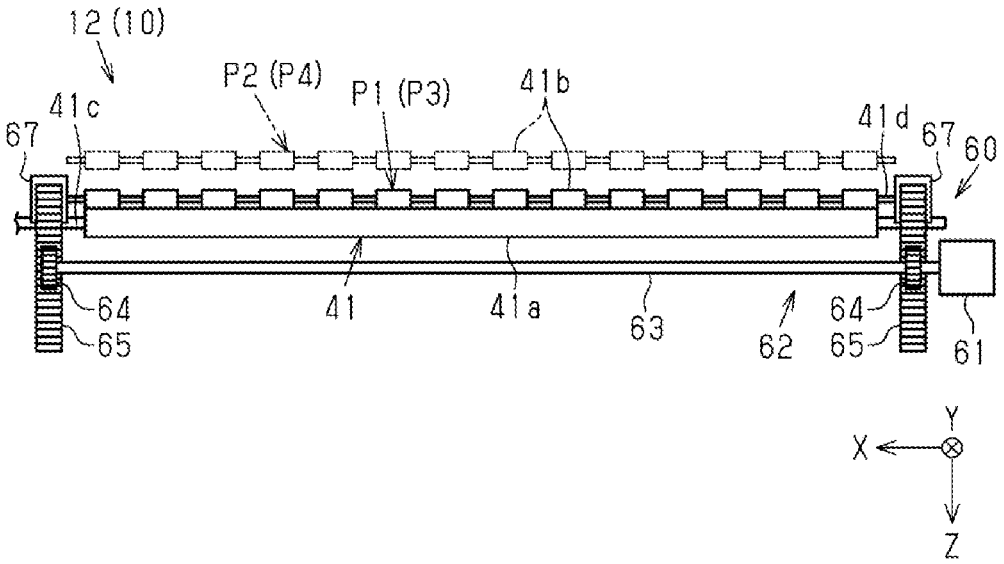
FIG. 3 is a schematic view illustrating the intermediate roller pair and a load changing unit.

As illustrated in FIG. 3, the second driving roller 41*a* can rotate around a drive rotation shaft 41*c* extending in the width direction X. The second driving roller 41*a* may have a columnar shape extending in the width direction X. The second driving roller 41*a* may have a columnar shape extending in the width direction X.

The second driven roller 41*b* can rotate around a driven rotation shaft 41*d* extending in the width direction X. The second driven roller 41*b* may have a columnar shape extending in the width direction X. The number of the second driven roller 41*b* provided in the intermediate roller pair 41 may be one. A plurality of the second driven rollers 41*b* may be separated from each other in the width direction X.

The intermediate roller pair 41 is displaceable to a sandwiching position P1 where the medium M can be sandwiched, and a separation position P2. When the intermediate roller pair 41 is located at the sandwiching position P1, the medium M can be nipped by the intermediate roller pair 41. When the intermediate roller pair 41 is located at the separation position P2, the second driving roller 41*a* and the second driven roller 41*b* are separated from each other than when the intermediate roller pair 41 is located at the sandwiching position P1. When the intermediate roller pair 41 is located at the separation position P2, the medium M can be released by the intermediate roller pair 41.

In the intermediate roller pair 41 of this embodiment, the second driven roller 41*b* is displaceable with respect to the second driving roller 41*a*. When the second driven roller 41*b* is displaced, the intermediate roller pair 41 is displaceable to the sandwiching position P1 and the separation position P2. When the second driven roller 41*b* is located at a lowered position P3 indicated with the solid line in FIG. 3, the intermediate roller pair 41 is located at the sandwiching position P1. When the second driven roller 41*b* is located at a lifted position P4 indicated with the chain double-dashed line in FIG. 3, the intermediate roller pair 41 is located at the separation position P2.

When the intermediate roller pair 41 is located at the sandwiching position P1, a pressing load PL acts on the second driving roller 41*a* from the second driven roller 41*b*. The magnitude of the pressing load PL when the intermediate roller pair 41 is located at the sandwiching position P1 is also referred to as a first pressing load PL1. When the intermediate roller pair 41 is located at the separation position P2, the pressing load PL from the second driven roller 41*b* to the second driving roller 41*a* is not generated.

Second Driving Unit

As illustrated in FIG. 1, the conveyance unit 12 may include a second driving unit 42 that drives the second driving roller 41*a*. When the second driving unit 42 drives the second driving roller 41*a* into rotation, the intermediate roller pair 41 conveys the medium M in the conveyance direction YD.

The second driving unit 42 may include an intermediate motor 43, an intermediate transmission mechanism 44, and an intermediate rotation detection unit 45. The intermediate motor 43 is a DC motor, for example. The intermediate motor 43 generates an intermediate driving torque for driving the intermediate roller pair 41.

The intermediate transmission mechanism 44 transmits the intermediate driving torque generated by the intermediate motor 43 to the second driving roller 41*a* at a predetermined reduction ratio. The second driving roller 41*a* rotates when the conveyance driving torque is transmitted from the intermediate transmission mechanism 44.

When the intermediate motor 43 is driven into forward rotation, the intermediate roller pair 41 rotates in the forward rotation direction. By rotating in the forward rotation direction, the intermediate roller pair 41 can convey, toward the conveyance roller pair 21, the medium M in the conveyance direction YD. When the intermediate motor 43 is driven into reverse rotation, the intermediate roller pair 41 rotates in the reverse rotation direction. By rotating in the reverse rotation direction, the intermediate roller pair 41 can convey, toward the roll 36, the medium M in the direction opposite to the conveyance direction YD.

The intermediate rotation detection unit 45 detects the rotational position and rotational direction of an intermediate output shaft 43*a* of the intermediate motor 43. The intermediate rotation detection unit 45 is a rotary encoder composed of a photo-interrupter and a scale with a disk shape provided at the intermediate output shaft 43*a* of the intermediate motor 43, for example.

Load Changing Unit

As illustrated in FIG. 3, the conveyance unit 12 includes a load changing unit 60. The load changing unit 60 changes the pressing load PL acting between the second driving roller 41*a* and the second driven roller 41*b*. The load changing unit 60 displaces the second driven roller 41*b* between the lowered position P3 and the lifted position P4. In this manner, the load changing unit 60 of this embodiment changes the pressing load PL that acts on the second driven roller 41*b* from the second driving roller 41*a*.

The load changing unit 60 may include an electric motor 61, and a rack and pinion mechanism 62. The rack and pinion mechanism 62 includes a shaft member 63, two pinions 64, two racks 65, and two supporting members 67. The shaft member 63 extends in the width direction X. The shaft member 63 is coupled with an output shaft of the electric motor 61. Each of the pinions 64 is fixed at a respective one of both end portions of the shaft member 63 in the width direction X. The two racks 65 are located such that each of the racks 65 meshes with a respective one of the two pinions 64. The supporting member 67 is located one at one and the other of the intermediate roller pair 41 in the width direction X. The two supporting members 67 rotatably support both end portions of the driven rotation shaft 41*d* of the second driven roller 41*b*. The rack 65 is fixed to the supporting member 67.

When the electric motor 61 is driven into reverse rotation from the state where the intermediate roller pair 41 is located at the sandwiching position P1, the second driven roller 41*b* is displaced from the lowered position P3 to the lifted position P4 and thus separated away from the second driving roller 41*a*. The intermediate roller pair 41 is then located at the separation position P2.

When the electric motor 61 is driven into forward rotation from the state where the intermediate roller pair 41 is located at the separation position P2, the second driven roller 41*b* is displaced from the lifted position P4 to the lowered position P3 and thus brought closer to the second driving roller 41*a*. The intermediate roller pair 41 is then located at the sandwiching position P1.

Control Unit

Figure 4:
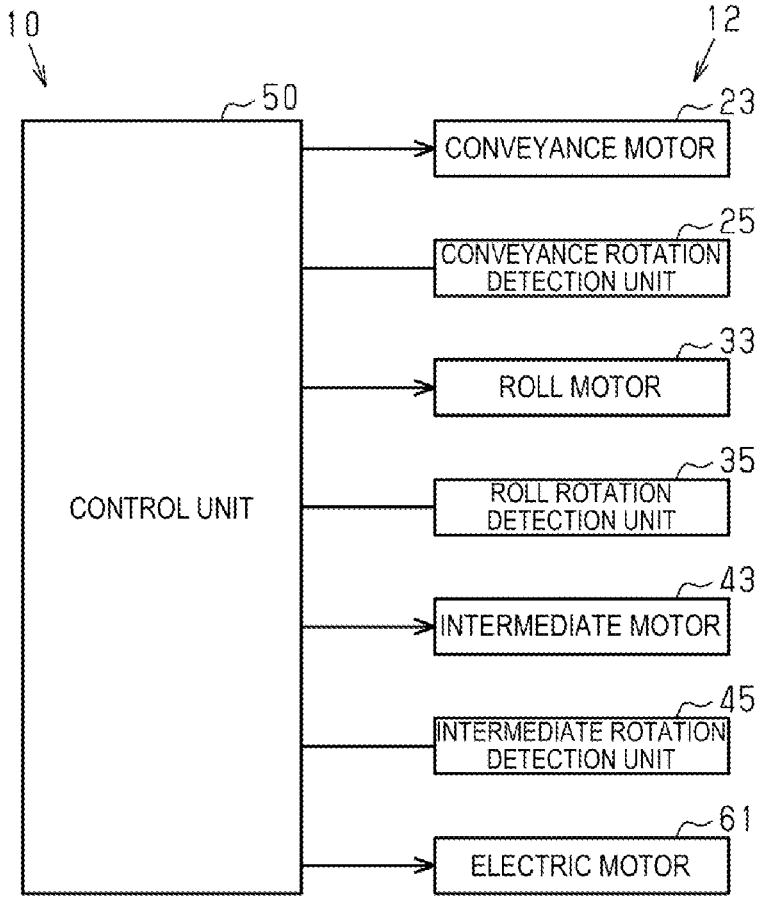
FIG. 4 is a block diagram illustrating an electrical configuration of the printing apparatus.

As illustrated in FIG. 4, the printing apparatus 10 includes the control unit 50. The control unit 50 controls various operations executed in the printing apparatus 10. The control unit 50 controls the conveyance unit 12. The control unit 50 may be configured as a circuit including (α) one or more processors that execute various processes in accordance with a computer program, (β) one or more dedicated hardware circuits that execute at least some of various processes, or (γ) a combination of them. The hardware circuit is an application-specific integrated circuit, for example. The processor includes a CPU and a memory such as a RAM and a ROM, and the memory stores a program code or a command configured to cause the CPU to execute processing. The memory, i.e., a computer readable medium, includes any readable media that are accessible with general-purpose or dedicated computers.

The control unit 50 may be electrically couplable to the conveyance motor 23. The control unit 50 controls the driving of the conveyance motor 23. Specifically, the control unit 50 controls the first driving unit 22. The control unit 50 may drive the conveyance motor 23 such that the conveyance roller pair 21 rotates in the forward rotation direction when a printing condition is met. The printing condition may be met when a printing request input in accordance with an operation of an operation unit not illustrated in the drawing. The printing condition may be met when a printing request is input from a terminal apparatus not illustrated in the drawing. When the conveyance roller pair 21 rotates in the forward rotation direction along with the driving of the conveyance motor 23, the medium M is conveyed with the conveyance roller pair 21. The control unit 50 may drive the conveyance motor 23 such that the conveyance roller pair 21 rotates in the reverse rotation direction. The control unit 50 may control the driving of the conveyance motor 23 by controlling the supply of the constant power to the conveyance motor 23 through a pulse width modulation (PWM) control.

The control unit 50 may be electrically coupled to the roll motor 33. The control unit 50 may control the driving of the roll motor 33. The roll motor 33 may be driven such that the roll 36 rotates in the forward rotation direction when a printing condition is met. The roll motor 33 may be driven such that the roll 36 rotates in the forward rotation direction when a printing condition is met. The control unit 50 may drive the roll motor 33 such that the roll 36 rotates in the reverse rotation direction. The control unit 50 may control the driving of the roll motor 33 by controlling the supply of the constant power to the roll motor 33 through a PWM control.

The control unit 50 may be electrically coupled to the intermediate motor 43. The control unit 50 may control the driving of the intermediate motor 43. Specifically, the control unit 50 may control the second driving unit 42. The control unit 50 may drive the intermediate motor 43 such that the intermediate roller pair 41 rotates in the forward rotation direction when a printing condition is met. When the intermediate roller pair 41 rotates in the forward rotation direction along with the driving of the intermediate motor 43, the medium M is conveyed by the intermediate roller pair 41 toward the conveyance roller pair 21. The control unit 50 may drive the intermediate motor 43 such that the intermediate roller pair 41 rotates in the reverse rotation direction. The control unit 50 controls the driving of the intermediate motor 43 by controlling the supply of the constant power to the intermediate motor 43 through a PWM control.

As illustrated in FIG. 1, the control unit 50 conveys the medium M by causing the conveyance unit 12 to repeat intermittent conveyance. The intermittent conveyance is an operation of switching stop of the conveyance of the medium M and conveyance of the medium M at the conveyance unit 12 in a preliminarily set cycle. The control unit 50 controls the first driving unit 22 to perform the rotation and stop of the first driving roller 21*a* in an alternate manner in the intermittent conveyance in which the conveyance and the stop of the conveyance of the medium M are performed in an alternate manner. The control unit 50 causes the printing unit 11 to perform the printing operation when the conveyance of the medium M is stopped in the intermittent conveyance.

During the conveyance of the medium M by the conveyance unit 12, the conveyance motor 23 is driven such that the conveyance roller pair 21 rotates in the forward rotation direction. During the conveyance of the medium M by the conveyance unit 12, the roll motor 33 is driven such that the roll 36 rotates in the forward rotation direction. During the conveyance of the medium M by the conveyance unit 12, the intermediate motor 43 is driven such that the intermediate roller pair 41 rotates in the forward rotation direction. When the conveyance of the medium M by the conveyance unit 12 is stopped, the driving of each of the conveyance motor 23, the roll motor 33, and the intermediate motor 43 may be stopped.

As illustrated in FIG. 4, the control unit 50 may be electrically coupled to the conveyance rotation detection unit 25. A pulse signal may not be input to the control unit 50 from the conveyance rotation detection unit 25. For example, the control unit 50 acquires the rotational position and rotational direction of the conveyance output shaft 23*a* detected by the conveyance rotation detection unit 25. The control unit 50 acquires the rotational position and rotational speed of the first driving roller 21*a* based on the acquired rotational position and rotational direction of the conveyance output shaft 23*a*. The control unit 50 can execute the feedback control of the first driving roller 21*a* based on the acquired rotational position and rotational speed of the first driving roller 21*a*.

The control unit 50 may be electrically coupled to the roll rotation detection unit 35. A pulse signal may be input to the control unit 50 from the roll rotation detection unit 35. For example, the control unit 50 acquires the rotational position and rotational direction of the roll output shaft 33*a* detected by the roll rotation detection unit 35. The control unit 50 acquires the rotational position and rotational speed of the holder 31*a* based on the acquired rotational position and rotational speed of the output shaft 33*a*. The control unit 50 can execute the feedback control of the feeding unit 30 based on the acquired rotational position and rotational speed of the holder 31*a*.

The control unit 50 may be electrically coupled to the intermediate rotation detection unit 45. A pulse signal may be input to the control unit 50 from the intermediate rotation detection unit 45. For example, the control unit 50 acquires the rotational position and rotational direction of the intermediate output shaft 43*a* detected by the intermediate rotation detection unit 45. The control unit 50 acquires the rotational position and rotational speed of second driving roller 41*a* based on the acquired rotational position and rotational direction of the intermediate output shaft 43*a*. The control unit 50 can execute the feedback control of the second driving roller 41*a* based on the acquired rotational position and rotational speed of the second driving roller 41*a*.

The control unit 50 may execute a position feedback control and a speed feedback control. The position feedback control is a PID control related to the rotational positions of the first driving roller 21*a*, the second driving roller 41*a*, and the holder 31*a*. The speed feedback control is a PID control related to the rotational speeds of the first driving roller 21*a*, the second driving roller 41*a*, and the holder 31*a*. When a target value of the rotational speed is input to the control unit 50, the control unit 50 executes the position feedback control. When a target value of the rotational speed of the first driving roller 21*a* is input to the control unit 50, the control unit 50 executes the speed feedback control. Note that the feedback control may be performed through a PI control.

Intermediate Adjustment Operation and Feed Adjustment Operation

As illustrated in FIG. 1, the control unit 50 can control the second driving unit 42 and the feeding unit 30, and can execute an intermediate adjustment operation M1 and a feed adjustment operation M2 by controlling the second driving unit 42 and the feeding unit 30. In the intermediate adjustment operation M1, the control unit 50 adjusts tension T of the medium M located between the conveyance roller pair 21 and the intermediate roller pair 41 by controlling the second driving unit 42 so as to rotate the second driving roller 41*a*. In the feed adjustment operation M2, the control unit 50 adjusts the tension T of the medium M located between the intermediate roller pair 41 and the feeding unit 30 by controlling the feeding unit 30.

In the intermediate adjustment operation M1, the control unit 50 may adjust the tension T of the medium M located between the conveyance roller pair 21 and the intermediate roller pair 41 to first target tension Ta. In the feed adjustment operation M2, the control unit 50 may adjust the tension T of the medium M located between the intermediate roller pair 41 and the feeding unit 30 to second target tension Tb.

The control unit 50 may perform a load acquisition operation M3 and a reference current acquisition operation M4. The control unit 50 may perform the intermediate adjustment operation M1 and the feed adjustment operation M2 based on information obtained through the load acquisition operation M3 and the reference current acquisition operation M4.

In the load acquisition operation M3, the control unit 50 can acquire an intermediate roller load N1 for a given rotational speed of the second driving roller 41*a* and a roll load N2 for a given rotational speed of the roll 36. It has been determined that the intermediate roller load N1 is in a linear relationship with the rotational speed of the second driving roller 41*a* from a result of an experiment and/or a simulation performed in advance. When mounting the roll 36 to the printing apparatus 10, the control unit 50 executes the load acquisition operation M3 that enables computation of the intermediate roller load N1 for a given rotational speed of the second driving roller 41*a*. It has been determined that the roll load N2 is in a linear relationship with the rotational speed of the roll 36 from a result of an experiment and/or a simulation performed in advance. When mounting the roll 36 to the printing apparatus 10, the control unit 50 executes the load acquisition operation M3 that enables computation of the roll load N2 for a given rotational speed of the roll 36.

In the reference current acquisition operation M4, the control unit 50 can acquire the current flowing through the intermediate motor 43 when the intermediate motor 43 is driven with the same rotational speed and driving time as those of the conveyance of the medium M. In the reference current acquisition operation M4, the control unit 50 can acquire the current flowing through the roll motor 33 when the roll motor 33 is driven with the same rotational speed and driving time as those of the conveyance of the medium M.

Tension of Medium Between Conveyance Roller Pair and Intermediate Roller Pair

The tension T of the medium M located between the conveyance roller pair 21 and the intermediate roller pair 41 is described below. First, the following describes first tension T1, which is the tension T acting on the medium M located between the conveyance roller pair 21 and the intermediate roller pair 41 in the case where the medium M of the state of being supported by the conveyance roller pair 21 and the intermediate roller pair 41 is conveyed with the conveyance roller pair 21 alone.

In the case where the medium M of the state of being supported by the conveyance roller pair 21 and the intermediate roller pair 41 is conveyed with the conveyance roller pair 21 alone, the medium M is pulled by the first driving roller 21*a*. As a result, the second driving roller 41*a* rotates in a driven manner in the forward rotation direction. The intermediate roller load N1, which is a load required for rotating the intermediate roller pair 41, is generated at the intermediate roller pair 41. At this time, the first tension T1 is expressed by the following Equation (1). Note that a first proportional constant k1 is a constant set based on a result of an experiment and/or a simulation performed in advance. A first radius R1 is a radius of the second driving roller 41*a*.

$$T1=k1\times N1/R1 \quad (1)$$

Next, the first tension T1 of the case where the medium M is sent by using the conveyance roller pair 21 and the intermediate roller pair 41 is described. In this case, a first output torque Tq1 that rotates the second driving roller 41*a* in the forward rotation direction is generated at the second driving roller 41*a*. As a result, a torque obtained by subtracting the first output torque Tq1 from the intermediate roller load N1 is acting on the second driving roller 41*a*. The first tension T1 at this time can be expressed by the following Equation (2).

$$T1=k1\times(N1-Tq1)/R1 \quad (2)$$

From the above-described Equation (1) and Equation (2), the first output torque Tq1 of the second driving roller 41*a* can be expressed by the following Equation (3).

$$Tq1=N1-\{(R1/k1)\times T1\} \quad (3)$$

With the above-described Equation (3), the first proportional constant k1, the first radius R1, which is the radius of the second driving roller 41*a*, and the intermediate roller load N1 become known values. The first target tension Ta is input to the first tension T1 of the above-described Equation (3). In this manner, it is possible to compute the first output torque Tq1 of the second driving roller 41*a* required for generating the first target tension Ta at the medium M located between the conveyance roller pair 21 and the intermediate roller pair 41.

The first target tension Ta is set to a value with which a state where the medium M located between the conveyance roller pair 21 and the intermediate roller pair 41 is not skewed and broken is maintained. The first target tension Ta is set in accordance with the property of the medium M based on a result of an experiment and/or a simulation performed in advance. The set first target tension Ta is stored in the control unit 50 in association with the property of the medium M. Information related to the property of the medium M may be input to the control unit 50 through a user operation at an operation unit not illustrated in the drawing. The control unit 50 may select the first target tension Ta based on the input information related to the property of the medium M.

Tension of Medium Between Intermediate Roller Pair and Feeding Unit

The tension T of the medium M located between the intermediate roller pair 41 and the feeding unit 30 is described below. First, the following describes second tension T2, which is the tension T acting on the medium M located between the intermediate roller pair 41 and the feeding unit 30 in the case where the medium M of the state of being supported by the intermediate roller pair 41 and the feeding unit 30 is conveyed with the intermediate roller pair 41 alone.

In the case where the medium M of the state of being supported by the intermediate roller pair 41 and the feeding unit 30 is conveyed with the intermediate roller pair 41 alone, the medium M is pulled by the second driving roller 41*a*. As a result, the roll 36 rotates in a driven manner in the forward rotation direction. The roll load N2, which is a load required for rotating the roll 36, is generated at the roll 36. At this time, the second tension T2 is expressed by the following Equation (4). Note that a second proportional constant k2 is a constant set based on a result of an experiment and/or a simulation performed in advance. A second radius R2 is the radius of the roll 36.

$$T2=k2\times N2/R2 \quad (4)$$

Next, the second tension T2 of the case where the medium M is sent by using the intermediate roller pair 41 and the feeding unit 30 is described. In this case, a second output torque Tq2 that rotates the roll 36 in the forward rotation direction is generated at the roll 36. As a result, a torque obtained by subtracting the second output torque Tq2 from the roll load N2 is acting on the roll 36. The second tension T2 at this time can be expressed by the following Equation (5).

$$T2=k2\times(N2-Tq2)/R2 \quad (5)$$

From the above-described Equation (4) and Equation (5), the second output torque Tq2 of the roll 36 can be expressed by the following Equation (6).

$$Tq2=N2-\{(R2/k2)\times T2\} \quad (6)$$

With the above-described Equation (6), the second proportional constant k2, the second radius R2, which is the radius of the roll 36, and the roll load N2 become known values. It is possible to compute the second output torque Tq2 of the roll 36 required for generating the second target tension Tb at the medium M located between the intermediate roller pair 41 and the feeding unit 30 by inputting the second target tension Tb to the second tension T2 of the above-described Equation (6).

The second target tension Tb is set to a value with which a state where the medium M located between the intermediate roller pair 41 and the feeding unit 30 is not skewed and broken is maintained. The second target tension Tb is set in accordance with the property of the medium M based on a result of an experiment and/or a simulation performed in advance. The set second target tension Tb is stored in the control unit 50 in association with the property of the medium M. The control unit 50 may select the second target tension Tb based on the input information related to the property of the medium M.

As illustrated in FIG. 4, the control unit 50 may be electrically coupled to the electric motor 61. The control unit 50 controls the driving of the electric motor 61. Specifically, the control unit 50 controls the load changing unit 60.

The control unit 50 can execute a first control C1. In the first control C1, the control unit 50 controls the load changing unit 60 such that the pressing load PL is the first pressing load PL1 when the first driving roller 21*a* is rotated in the intermittent conveyance of the medium M. The control unit 50 can execute a second control C2. In the second control C2, the control unit 50 controls the load changing unit 60 such that the pressing load PL is not generated when the rotation of the first driving roller 21*a* is stopped in the intermittent conveyance of the medium M.

The control unit 50 may execute the second control C2 each time the rotation of the conveyance roller pair 21 is stopped. The control unit 50 may execute the first control C1 after the second control C2 is executed when the rotation of the first driving roller 21*a* is stopped in the intermittent conveyance of the medium M.

Conveyance Control Method of Medium

Figure 5:
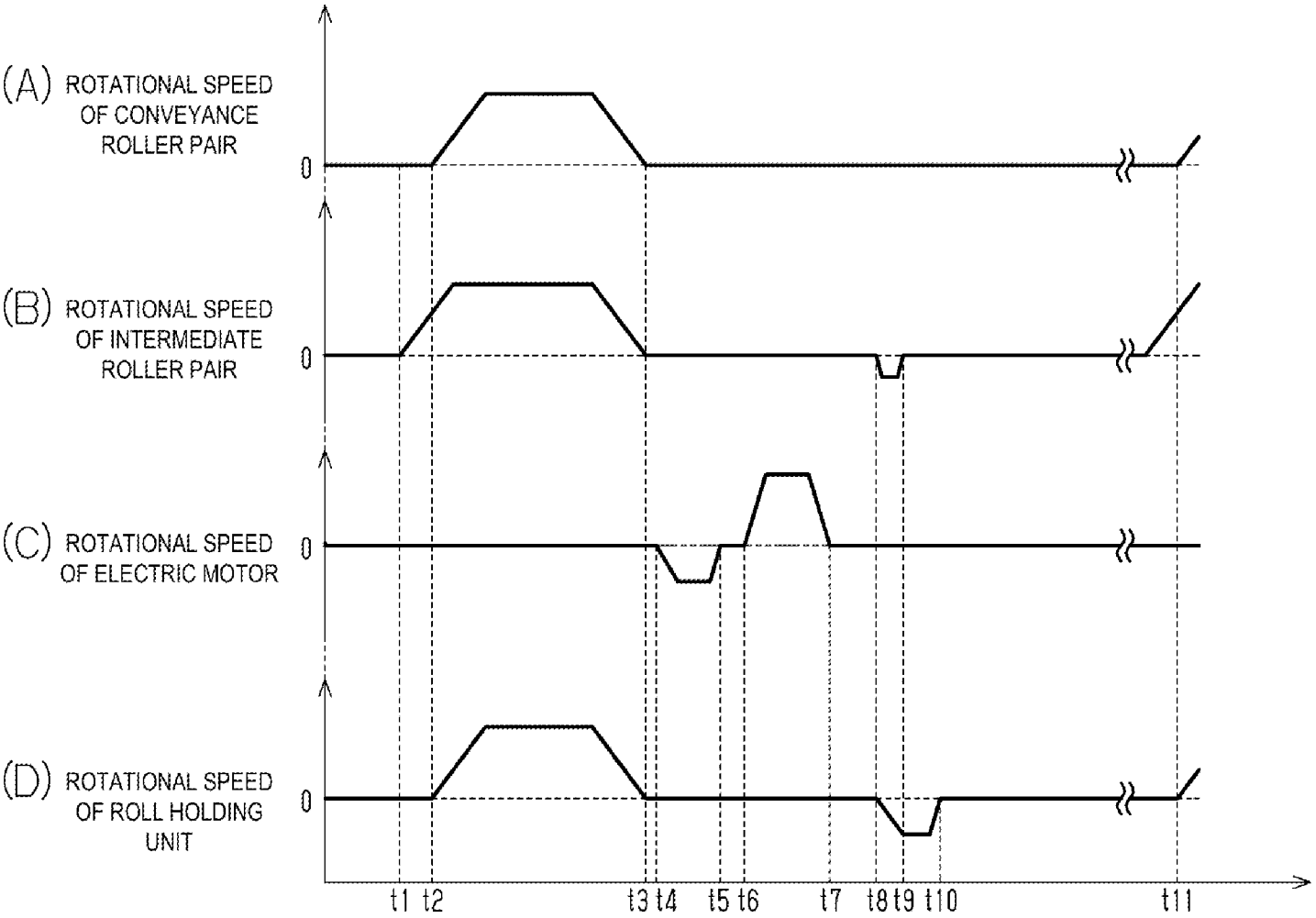
FIG. 5 is a timing diagram illustrating a control of a control unit in the embodiment.

Next, an example of a conveyance control method of conveying the medium M with the conveyance unit 12 is described. In FIG. 5, the abscissa indicates time. In FIG. 5, the ordinate indicates the rotational speed of each of the conveyance roller pair 21, the intermediate roller pair 41, the electric motor 61, and the roll holding unit 31. In FIG. 5, the + rotational speed represents a rotational speed in forward rotation driving, and the − rotational speed represents a rotational speed in reverse rotation driving.

As illustrated in FIG. 5, at time t1, the control unit 50 drives the intermediate roller pair 41 into forward rotation while performing the intermediate adjustment operation M1 by controlling the second driving unit 42. More specifically, the control unit 50 controls the second driving unit 42 such that the intermediate roller pair 41 is driven into forward rotation in the state where the driving of the conveyance roller pair 21 is stopped. In this embodiment, the drive start timing of the intermediate roller pair 41 is earlier than the drive start timing of the conveyance roller pair 21.

Figure 6:
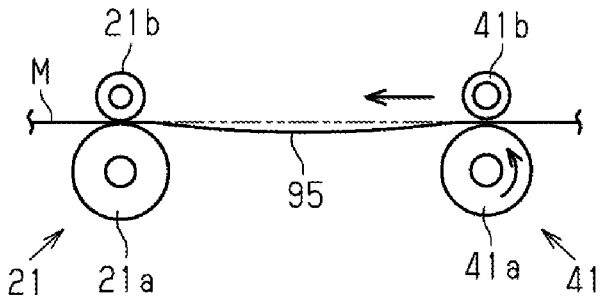
FIG. 6 is a schematic view for describing an intermediate adjustment operation.

As illustrated in FIG. 6, in the intermediate adjustment operation M1 of this embodiment, the control unit 50 forms slack 95 in the medium M between the conveyance roller pair 21 and the intermediate roller pair 41. The control unit 50 maintains the tension T at the first target tension Ta while maintaining the slack 95 in the medium M located between the conveyance roller pair 21 and the intermediate roller pair 41 by driving the intermediate motor 43 into forward rotation.

As illustrated in FIG. 5, at time t2, the control unit 50 rotates the conveyance roller pair 21 in the forward rotation direction by driving the conveyance motor 23 into forward rotation. At time t2, the control unit 50 rotates the roll holding unit 31 in the forward rotation direction by driving the roll motor 33 into forward rotation. The medium M is conveyed from the conveyance roller pair 21 to the conveyance direction YD.

The control unit 50 drives the roll holding unit 31 into forward rotation while performing the feed adjustment operation M2 by controlling the roll motor 33 of the feeding unit 30. The control unit 50 maintains the tension T in the medium M located between the intermediate roller pair 41 and the feeding unit 30 at the second target tension Tb by driving the roll motor 33 into forward rotation.

With the above-described slack 95 formed between the conveyance roller pair 21 and the intermediate roller pair 41, the conveyance of the medium M with the conveyance roller pair 21 can be smoothly started. In addition, the intermediate roller pair 41 driven into forward rotation at an earlier timing can make forward rotation without lagging behind the acceleration the conveyance roller pair 21 due to its own inertia and the like.

The control unit 50 continues the forward rotation driving of the conveyance motor 23, the intermediate motor 43, and the roll motor 33 until time t3. In this manner, the forward rotation driving of the conveyance roller pair 21, the intermediate roller pair 41, and the roll holding unit 31 is continued until time t3. In a period between time t2 and time t3, a predetermined conveyance amount of the medium M is conveyed from the conveyance roller pair 21. In this embodiment, the period from time t2 to time t3 corresponds to the time when the first driving roller 21*a* is rotated in the intermittent conveyance of the medium M. At time t3, the control unit 50 stops the driving of the conveyance motor 23, the intermediate motor 43, and the roll motor 33.

After stopping the driving of the conveyance motor 23, the intermediate motor 43, and the roll motor 33, the control unit 50 executes the second control C2 at time t4. The control unit 50 may execute the second control C2 on condition that the forward rotation driving of the conveyance motor 23 is stopped. In the second control C2, the control unit 50 controls the load changing unit 60 such that the pressing load PL is not generated when the rotation of the first driving roller 21*a* is stopped due to the intermittent conveyance of the medium M.

Figure 7:
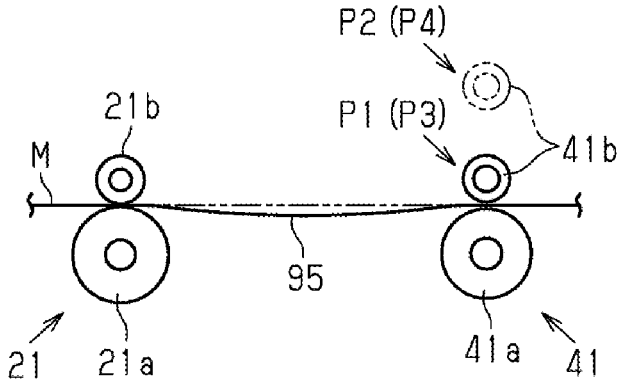
FIG. 7 is a schematic view for describing a first control and a second control.

As illustrated in FIGS. 5 and 7, in the second control C2, the control unit 50 drives the electric motor 61 into reverse rotation. As a result, the second driven roller 41*b* is displaced from the lowered position P3 to the lifted position P4. The intermediate roller pair 41 is displaced from the sandwiching position P1 where the medium M can be sandwiched to the separation position P2 where the pressing load PL is not generated.

At time t5, the control unit 50 stops the reverse rotation driving of the electric motor 61 associated with the second control C2. As a result, the position of the second driven roller 41*b* is maintained at the lifted position P4. The position of the intermediate roller pair 41 is maintained at the separation position P2. Until the first control C1 is executed by the control unit 50 at time t6, the position of the intermediate roller pair 41 is maintained at the separation position P2. As such, it can be said that the control unit 50 of this embodiment executes the second control C2 in the period from time t4 to time t6.

As illustrated in FIG. 5, at time t6, the control unit 50 executes the first control C1. The control unit 50 starts the first control C1 at the time when the rotation of the first driving roller 21*a* is stopped in the intermittent conveyance of the medium M after the second control C2 is executed. In the first control C1, the control unit 50 controls the load changing unit 60 such that the pressing load PL is the first pressing load PL1.

As illustrated in FIGS. 5 and 7, in the first control C1, the control unit 50 drives the electric motor 61 into forward rotation. As a result, the second driven roller 41*b* is displaced from the lifted position P4 to the lowered position P3. The intermediate roller pair 41 is displaced from the separation position P2 to the sandwiching position P1. When the intermediate roller pair 41 is located at the sandwiching position P1, the pressing load PL is set at the first pressing load PL1.

At time t7, the control unit 50 stops the reverse rotation driving of the electric motor 61 associated with the first control C1. As a result, the position of the second driven roller 41*b* is maintained at the lowered position P3. The position of the intermediate roller pair 41 is maintained at the sandwiching position P1. The pressing load PL acting on the second driving roller 41*a* from the second driven roller 41*b* is maintained at the first pressing load PL1. Until the next second control C2 is executed by the control unit 50, the position of the intermediate roller pair 41 is maintained at the sandwiching position P1. As such, it can be said that the control unit 50 of this embodiment executes the first control C1 in the period from time t6 to the execution of the next second control C2.

As illustrated in FIG. 5, after the execution of the first control C1, the control unit 50 executes an intermediate slack elimination operation M5 at time t8. Specifically, when the rotation of the first driving roller 21*a* is stopped in the intermittent conveyance of the medium M, the control unit 50 executes the intermediate slack elimination operation M5 after the execution of the first control C1. In the intermediate slack elimination operation M5, the control unit 50 controls the second driving unit 42 so as to rotate the second driving roller 41*a* in the direction opposite to the direction of conveying the medium M toward the conveyance roller pair 21. The intermediate slack elimination operation M5 eliminates the slack 95 of the medium M located between the conveyance roller pair 21 and the intermediate roller pair 41. When the intermediate slack elimination operation M5 is performed, the conveyance error resulting from the conveyance operation can be eliminated for the medium M located between the conveyance roller pair 21 and the intermediate roller pair 41. The conveyance error is the difference in conveyance amount at both end portions of the medium M in the width direction X.

Figure 8:
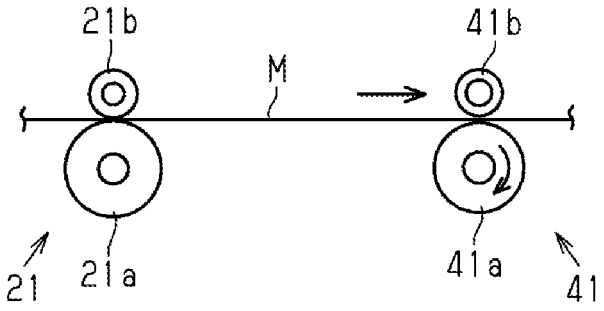
FIG. 8 is a schematic view for describing an intermediate slack elimination operation.

As illustrated in FIG. 8, in the intermediate slack elimination operation M5, the control unit 50 drives the intermediate roller pair 41 into reverse rotation through the speed feedback control with an intermediate slack eliminating speed as the target speed. The intermediate slack eliminating speed is set in accordance with the property of the medium M based on a result of an experiment and/or a simulation performed in advance. Note that the control unit 50 may simultaneously perform a torque feedback control with the intermediate slack eliminating torque as the target torque in addition to the speed feedback control. As with the intermediate slack eliminating speed, the intermediate slack eliminating torque is set in accordance with the property of the medium M based on a result of an experiment and/or a simulation performed in advance.

As illustrated in FIG. 5, the control unit 50 executes a feed slack elimination operation M6 after the execution of the first control C1 at time t8. In the feed slack elimination operation M6, the control unit 50 rotates the roll holding unit 31 by driving the roll motor 33. When the feed slack elimination operation M6 is performed by the control unit 50, the slack 95 of the medium M located between the intermediate roller pair 41 and the feeding unit 30 is eliminated. The feed slack elimination operation M6 is an operation of eliminating the conveyance error resulting from the conveyance operation for the medium M located between the intermediate roller pair 41 and the feeding unit 30.

Figure 9:
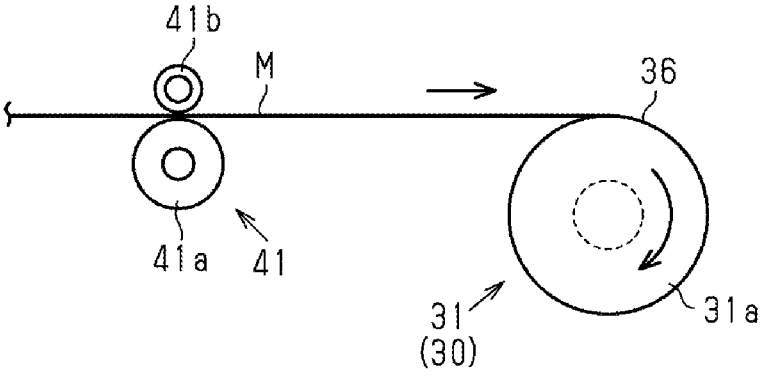
FIG. 9 is a schematic view for describing a feed slack elimination operation.

As illustrated in FIG. 9, in the feed slack elimination operation M6, the control unit 50 drives the roll holding unit 31 into reverse rotation through the speed feedback control with a feed slack eliminating speed as the target speed. The feed slack eliminating speed is set in accordance with the property of the medium M based on a result of an experiment and/or a simulation performed in advance. Note that the control unit 50 may simultaneously perform the torque feedback control with a feed slack eliminating torque as the target torque in addition to the speed feedback control. As with the feed slack eliminating speed, the feed slack eliminating torque is set in accordance with the property of the medium M based on a result of an experiment and/or a simulation performed in advance. The increase rate of the feed slack eliminating speed may be smaller than the intermediate slack eliminating speed. The upper limit value of the feed slack eliminating speed may be greater than the upper limit value of the intermediate slack eliminating speed.

As illustrated in FIG. 5, at time t9, when the tension T acting on the medium M located between the conveyance roller pair 21 and the intermediate roller pair 41 reaches a predetermined value, the control unit 50 terminates the intermediate slack elimination operation M5. At time t10, when the tension T acting on the medium M located between the intermediate roller pair 41 and the feeding unit 30 reaches a predetermined value, the control unit 50 terminates the feed slack elimination operation M6.

At time t11, the control unit 50 causes the conveyance unit 12 to start the conveyance operation of the medium M again. The control unit 50 may cause the printing unit 11 to perform the printing of the medium M in the period from time t10 at which the feed slack elimination operation M6 is terminated to time t11. Along with the start of the conveyance operation of the medium M, the control unit 50 causes the first driving roller 21*a* to make forward rotation. At this time, along with the execution of the first control C1 by the control unit 50, the position of the intermediate roller pair 41 is maintained at the sandwiching position P1. The pressing load PL acting on the second driving roller 41*a* from the second driven roller 41*b* is maintained at the first pressing load PL1. As such, it can be said that in the first control C1, the control unit 50 controls the load changing unit 60 such that the pressing load PL is the first pressing load PL1 when the first driving roller 21*a* is rotated in the intermittent conveyance of the medium M. In this embodiment, the period from time t3 to time t11 corresponds to the time when the rotation of the first driving roller 21*a* is stopped in the intermittent conveyance of the medium M.

After time t11, the control unit 50 executes the second control C2 again after the control unit 50 has stopped the rotation of the conveyance roller pair 21 and the intermediate roller pair 41 associated with the conveyance of the medium M. The control unit 50 executes the first control C1 after the execution of the second control C2. The control unit 50 of this embodiment executes the second control C2 each time the rotation of the conveyance roller pair 21 is stopped.

Operations of First Embodiment

Operations this embodiment are described below.

The control unit 50 executes the second control C2 when the rotation of the first driving roller 21*a* is stopped in the intermittent conveyance of the medium M. In the second control C2, the control unit 50 drives the electric motor 61 of the load changing unit 60 into reverse rotation. The second driven roller 41*b* is displaced from the lowered position P3 to the lifted position P4. The intermediate roller pair 41 is displaced from the sandwiching position P1 to the separation position P2. When the intermediate roller pair 41 is located at the separation position P2, the pressing load PL from the second driven roller 41*b* to the second driving roller 41*a* is not generated. Thus, the medium M is not sandwiched by the second driving roller 41*a* and the second driven roller 41*b*. It is possible to eliminate wrinkles of the medium M formed in the vicinity of the conveyance area of the intermediate roller pair 41 along with the displacement of the intermediate roller pair 41 from the sandwiching position P1 to the separation position P2.

The control unit 50 executes the first control C1 when the first driving roller 21*a* is rotated in the intermittent conveyance of the medium M. In the first control C1, the control unit 50 drives the electric motor 61 of the load changing unit 60 into forward rotation. The second driven roller 41*b* is displaced from the lifted position P4 to the lowered position P3. The intermediate roller pair 41 is displaced from the separation position P2 to the sandwiching position P1. When the intermediate roller pair 41 is located at the sandwiching position P1, the pressing load PL that acts on the second driving roller 41*a* from the second driven roller 41*b* is the first pressing load PL1. Thus, the medium M can be sandwiched by the second driving roller 41*a* and the second driven roller 41*b*. In the state where the medium M is sandwiched by the intermediate roller pair 41, the printing of the medium M by the printing unit 11, and the conveyance of the medium M by the conveyance roller pair 21 and the intermediate roller pair 41 can be performed.

Effects of First Embodiment

Effects of this embodiment are described below.

(1) When the rotation of the first driving roller 21*a* is stopped in the intermittent conveyance, the control unit 50 executes the second control C2 that controls the load changing unit 60 such that the pressing load PL is not generated. As a result, the load that acts on the medium M from the intermediate roller pair 41 at the execution of the second control C2 is smaller than at the execution of the first control C1. Thus, wrinkles of the medium M formed in the vicinity of the conveyance area of the intermediate roller pair 41 can be eliminated.

(2) The control unit 50 executes the second control C2 each time the rotation of the conveyance roller pair 21 is stopped. As a result, the frequency of execution of the second control C2 by the control unit 50 is higher in comparison with the case where the control unit 50 executes the second control C2 each time the rotation of the conveyance roller pair 21 is stopped multiple times. Thus, wrinkles formed in the medium M can be more frequently eliminated.

(3) The control unit 50 executes the first control C1 when the rotation of the first driving roller 21*a* is stopped in the intermittent conveyance after the second control C2 is executed. In this manner, the rotation of the first driving roller 21*a* can be started in the state where the pressing load PL at the intermediate roller pair 41 is set at the first pressing load PL1. Thus, the medium M can be conveyed in the state of being favorably sandwiched by the intermediate roller pair 41.

(4) The control unit 50 can execute the intermediate adjustment operation M1 that adjusts the tension T of the medium M located between the conveyance roller pair 21 and the intermediate roller pair 41 by controlling the second driving unit 42 so as to rotate the second driving roller 41*a*. Thus, conveyance errors caused in the medium M located between the conveyance roller pair 21 and the intermediate roller pair 41 during conveyance of the medium M can be eliminated through the intermediate adjustment operation M1. The control unit 50 can execute the feed adjustment operation M2 that adjusts the tension T of the medium M located between the intermediate roller pair 41 and the feeding unit 30 by controlling the feeding unit 30. Thus, conveyance errors caused in the medium M located between the intermediate roller pair 41 and the feeding unit 30 during conveyance of the medium M can be eliminated through the feed adjustment operation M2. Thus, the conveyance of the medium M with the conveyance roller pair 21 can be performed with high accuracy.

(5) The control unit 50 executes the intermediate slack elimination operation M5 that controls the second driving unit 42 so as to rotate the second driving roller 41*a* in the direction opposite to the direction of conveying the medium M toward the conveyance roller pair 21. Through the intermediate slack elimination operation M5, the slack 95 of the medium M located between the conveyance roller pair 21 and the intermediate roller pair 41 is eliminated. Thus, for the medium M located between the conveyance roller pair 21 and the intermediate roller pair 41, the accumulated conveyance errors in the width direction X and the accumulated errors of the slack amount can be reset.

Second Embodiment

A printing apparatus and a conveyance control method according to a second embodiment are described below with reference to the accompanying drawings. Note that the second embodiment is different from the first embodiment in the frequency of execution of the second control C2 by the control unit 50. The second embodiment and the first embodiment are the same in the other points. In the second embodiment, description of the same configurations as those of the first embodiment will be omitted as necessary.

The control unit 50 of this embodiment executes the second control C2 each time the rotation of the conveyance roller pair 21 is stopped multiple times. The control unit 50 of this embodiment executes the second control C2 each time the rotation of the conveyance roller pair 21 is stopped two times. In this case, for example, when the control unit 50 executes the second control C2 after the rotation of the conveyance roller pair 21 is stopped, the control unit 50 does not execute the second control C2 after the next stop of the rotation of the conveyance roller pair 21. Thus, in this embodiment, the execution and non-execution of the second control C2 by the control unit 50 alternate at the timing when the rotation of the conveyance roller pair 21 is stopped. Note that the control unit 50 may execute the second control C2 each time the rotation of the conveyance roller pair 21 is stopped three times or more.

As indicated with the solid line in FIG. 5, when executing the second control C2, the control unit 50 executes the second control C2 as in the first embodiment in the period from time t4 to time t6. In this manner, the intermediate roller pair 41 is displaced from the sandwiching position P1 to the separation position P2. As in the first embodiment, the control unit 50 executes the first control C1 after the execution of the second control C2. In this manner, the intermediate roller pair 41 is displaced from the separation position P2 to the sandwiching position P1.

As indicated with the chain double-dashed line in FIG. 5, in the case where the control unit 50 does not execute the second control C2, the control unit 50 does not drive the electric motor 61 into rotation when the rotation of the first driving roller 21*a* is stopped. The control unit 50 continues the execution of the first control C1 until the rotation of the first driving roller 21*a* rotated again is stopped. In this manner, the position of the intermediate roller pair 41 is maintained at the sandwiching position P1.

According to this embodiment, the same operations as those of the first embodiment can be achieved.

Effects of Second Embodiment

Effects of this embodiment are described below.

(6) The control unit 50 executes the second control C2 each time the rotation of the conveyance roller pair 21 is stopped multiple times. As a result, in comparison with the case where the control unit 50 executes the second control C2 each time the rotation of the conveyance roller pair 21 is stopped, the frequency of execution of the second control C2 by the control unit 50 is low. Thus, the load that acts on the load changing unit 60 along with the execution of the second control C2 can be reduced.

Modifications

The above-described embodiments may be modified as follows for implementation. The above-described embodiments and the following modifications may be combined for implementation insofar as they are not technically inconsistent.

Figure 10:
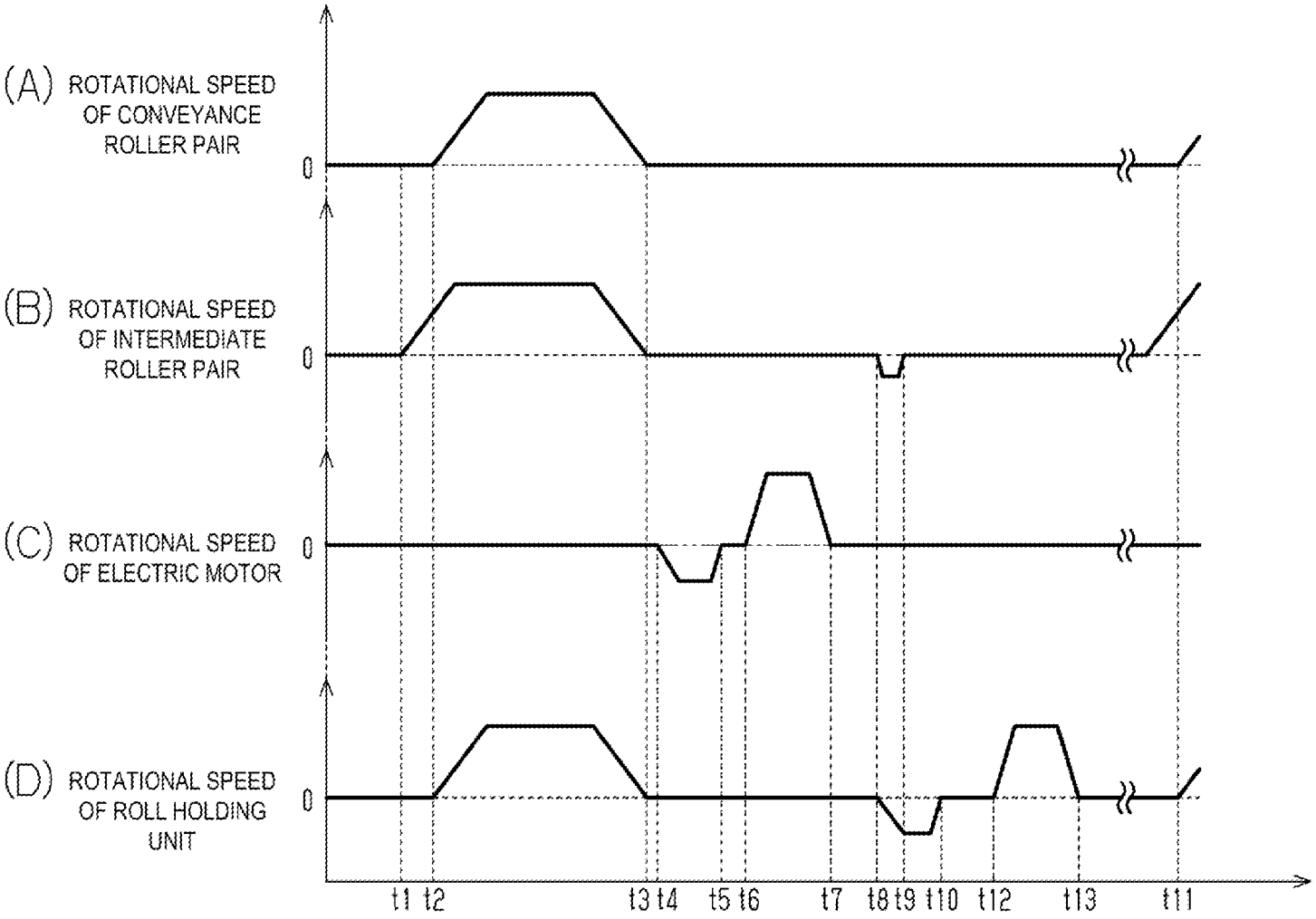
FIG. 10 is a timing diagram illustrating a control of a control unit of a modification.

As illustrated in FIG. 10, the control unit 50 may execute the intermediate adjustment operation M1 and a slack formation operation M7. In the intermediate adjustment operation M1, the control unit 50 adjusts the tension T of the medium M located between the conveyance roller pair 21 and the intermediate roller pair 41 by controlling the second driving unit 42 so as to rotate the second driving roller 41*a* as in the above-described embodiment. The control unit 50 may execute the slack formation operation M7 between time t10 at which the feed slack elimination operation M6 is terminated and time t11 at which the conveyance operation of the medium M is started again. More specifically, the control unit 50 starts the slack formation operation M7 at time t12, which is the time after time t10 and before time t11. At time t13, the slack formation operation M7 is terminated. The control unit 50 in this case may cause the printing unit 11 to perform the printing of the medium M between time t13 at which the slack formation operation M7 is terminated and time t11 at which the conveyance operation of the medium M is started again.

Figure 11:
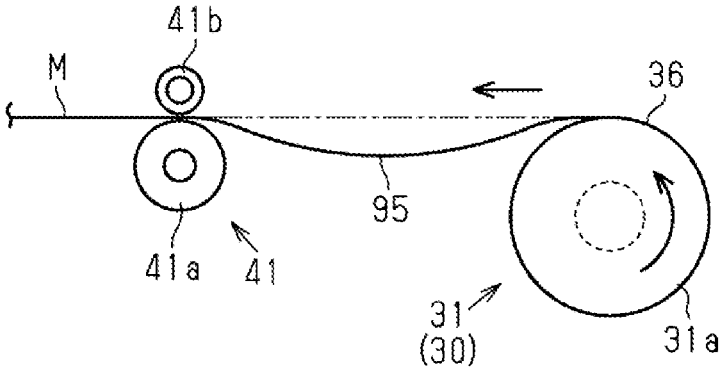
FIG. 11 is a schematic view for describing a slack formation operation.

As illustrated in FIG. 11, in the slack formation operation M7, the control unit 50 forms the slack 95 in the medium M located between the intermediate roller pair 41 and the feeding unit 30 by controlling the feeding unit 30 so as to feed the medium M from the roll 36 toward the conveyance roller pair 21. More specifically, in the slack formation operation M7, the control unit 50 drives the roll motor 33 into forward rotation through the position feedback control with a slack formation position as the target position. The slack formation position is a rotation position where the medium M is pulled out from the roll 36 by a predetermined slack amount. The control unit 50 terminates the slack formation operation M7 when the rotation position based on a pulse signal from the roll rotation detection unit 35 reaches the slack formation position. When the slack formation operation M7 is terminated, the slack 95 is formed in the medium M located between the intermediate roller pair 41 and the roll holding unit 31. The control unit 50 may eliminate the slack 95 formed by the slack formation operation M7 by performing the feed slack elimination operation M6.

According to the above-described modification, the following effects can be achieved.

(7) The control unit 50 can execute the intermediate adjustment operation M1 that adjusts the tension T of the medium M located between the conveyance roller pair 21 and the intermediate roller pair 41 by controlling the second driving unit 42 so as to rotate the second driving roller 41*a*. Thus, conveyance errors caused in the medium M located between the conveyance roller pair 21 and the intermediate roller pair 41 during conveyance of the medium M can be eliminated through the intermediate adjustment operation M1. The control unit 50 can execute the slack formation operation M7 that forms the slack 95 in the medium M located between the intermediate roller pair 41 and the feeding unit 30 by controlling the feeding unit 30 so as to feed the medium M from the roll 36 toward the conveyance roller pair 21. Thus, the intermediate roller pair 41 is less affected by the eccentricity, tilt and the like of the roll 36. As a result, reduction in conveyance accuracy at the intermediate roller pair 41, and in turn, reduction in conveyance accuracy at the conveyance roller pair 21 can be suppressed. Thus, the conveyance of the medium M with the conveyance roller pair 21 can be performed with high accuracy.

In the second control C2, the control unit 50 may control the load changing unit 60 such that the pressing load PL is set to a second pressing load PL2 smaller than the first pressing load PL1 when the rotation of the first driving roller 21*a* is stopped in the intermittent conveyance of the medium M. In this case, desirably, the second pressing load PL2 is 10% or less of the first pressing load PL1. The second pressing load PL2 may be greater than 10% of the first pressing load PL1. In this case, the pressing load PL that acts on the second driving roller 41*a* from the second driven roller 41*b* at the execution of the second control C2 is smaller than at the execution of the first control C1. As a result, the load that acts on the medium M from the intermediate roller pair 41 at the execution of the second control C2 is smaller than at the execution of the first control C1. Thus, it is possible to eliminate wrinkles formed in the medium M in the vicinity of the conveyance area of the intermediate roller pair 41 along with the execution of the second control C2.

The load changing unit 60 may change the pressing load PL that acts on the second driven roller 41*b* from the second driving roller 41*a*. In this case, for example, the load changing unit 60 may change the pressing load PL by displacing the second driving roller 41*a*. That is, it suffices that the load changing unit 60 changes the pressing load PL acting between the second driving roller 41*a* and the second driven roller 41*b*.

The control unit 50 may omit the execution of the intermediate slack elimination operation M5.

The control unit 50 may omit the execution of the feed slack elimination operation M6.

The control unit 50 may omit the execution of the intermediate adjustment operation M1. In the case where the control unit 50 omits the execution of the intermediate adjustment operation M1, the intermediate roller pair 41 is rotated by the intermediate motor 43 in a mode in which an intermediate driving torque set in advance is generated, for example. The control unit 50 may omit the execution of the feed adjustment operation M2. In the case where the control unit 50 omits the execution of the feed adjustment operation M2, the roll holding unit 31 is rotated by the roll motor 33 in a mode in which a roll driving torque set in advance is generated, for example. In the case where the control unit 50 omits the execution of both the intermediate adjustment operation M1 and the feed adjustment operation M2, the control unit 50 may omit the execution of the load acquisition operation M3 and the reference current acquisition operation M4.

The execution timing of the first control C1 by the control unit 50 is not limited to the time when the rotation of the first driving roller 21*a* is stopped after the second control C2 is executed in the intermittent conveyance of the medium M. For example, the control unit 50 may execute the first control C1 at the timing when the rotation of the first driving roller 21*a* is started after the execution of the second control C2.

The printing apparatus 10 may be a liquid discharging apparatus that jets and ejects liquid other than ink. Examples of the state of the liquid ejected in the form of a very small amount of droplets from the liquid discharging apparatus include granular shapes, teardrop shapes, and thread-like tail shapes. Here, the liquid need only be a material that can be ejected from the liquid discharging apparatus. For example, the liquid need only be a material in a liquid phase, and includes liquid materials with high or low viscosity, and fluid materials such as sols, gel waters, other inorganic solvents, organic solvents, solutions, liquid resins, liquid metals, and metal liquid solutions. The liquid includes not only liquid as a state of a material, but also particles of functional materials composed of solids, such as pigments and metal particles, dissolved, dispersed or mixed in a solvent. Typical examples of the liquid include the ink, liquid crystal and the like as described in the embodiments. Here, the ink encompasses various liquid compositions such as common water-based inks, oil inks, gel inks, and hot melt inks. Specific examples of liquid discharging apparatus include apparatuses that eject liquid containing materials, such as electrode materials and color materials in a dispersed or dissolved state, used for manufacturing and the like of liquid crystal displays, electroluminescence displays, surface-emission displays, and color filters, for example. The liquid discharging apparatus may be an apparatus that ejects biological organic materials used for manufacturing biochips, an apparatus that is used as a precision pipette and ejects liquid as a sample, a textile printing apparatus, a micro dispenser, and the like. The liquid discharging apparatus may be an apparatus that exactly ejects lubricating oil to precision machines such as clocks and cameras, and an apparatus that ejects transparent resin liquid such as ultraviolet curable resin onto a substrate for the purpose of forming optical lenses and minute hemisphere lenses used for optical communication elements and the like. The liquid discharging apparatus may be an apparatus that ejects acid or alkali etchant for the purpose of etching a substrate and the like.

Supplementary Notes

Technical ideas and operational effects thereof derived from the above-described embodiments and modifications are described below.

(A) A printing apparatus includes a printing unit configured to perform printing on a medium, a conveyance unit configured to convey the medium to the printing unit, and a control unit configured to control the conveyance unit, wherein the conveyance unit includes a feeding unit configured to feed the medium from a roll wound with the medium in a rolled form, a conveyance roller pair configured to convey, toward the printing unit, the medium fed by the feeding unit, and an intermediate roller pair configured to convey, toward the conveyance roller pair, the medium fed by the feeding unit at a position between the feeding unit and the conveyance roller pair, the conveyance roller pair includes a first driving roller, and a first driven roller configured to sandwich the medium together with the first driving roller, the intermediate roller pair includes a second driving roller, and a second driven roller configured to sandwich the medium together with the second driving roller, the conveyance unit includes a first driving unit configured to rotate the first driving roller, and a load changing unit configured to change a pressing load acting between the second driving roller and the second driven roller, and the control unit is configured to control the first driving unit such that the first driving roller is rotated and stopped in an alternate manner in an intermittent conveyance of conveying and stopping the medium in an alternate manner, execute a first control configured to control the load changing unit such that the pressing load is a first pressing load when the first driving roller is rotated in the intermittent conveyance, and execute a second control configured to control the load changing unit such that the pressing load is not generated or that the pressing load is a second pressing load smaller than the first pressing load when rotation of the first driving roller is stopped in the intermittent conveyance.

With this configuration, the control unit executes the second control that controls the load changing unit such that the pressing load is not generated or that the pressing load is the second pressing load smaller than the first pressing load when the rotation of the first driving roller is stopped in the intermittent conveyance. Thus, the load that acts on the medium from the intermediate roller pair at the execution of the second control is smaller than at the execution of the first control. Thus, wrinkles formed in the medium in the vicinity of the conveyance area of the intermediate roller pair can be eliminated.

(B) In the printing apparatus, the control unit executes the second control each time rotation of the conveyance roller pair is stopped.

With this configuration, the control unit executes the second control each time the rotation of the conveyance roller pair is stopped. As a result, the frequency of the execution of the second control by the control unit is higher than in the case where the control unit executes the second control each time the rotation of the conveyance roller pair is stopped multiple times. Thus, wrinkles formed in the medium can be more frequently eliminated.

(C) In the printing apparatus, the control unit executes the second control each time rotation of the conveyance roller pair is stopped multiple times.

With this configuration, the control unit executes the second control each time the rotation of the conveyance roller pair is stopped multiple times. As a result, the frequency of execution of the second control by the control unit is lower than in the case where the control unit executes the second control each time the rotation of the conveyance roller pair is stopped. Thus, the load that acts on the load changing unit due to the execution of the second control can be reduced.

(D) In the printing apparatus, the control unit executes the first control after the second control is executed when the rotation of the first driving roller is stopped in the intermittent conveyance.

With this configuration, the control unit executes the first control after the second control is executed when the rotation of the first driving roller is stopped in the intermittent conveyance. Thus, the rotation of the first driving roller can be started in the state where the pressing load at the intermediate roller pair is set to the first pressing load. Thus, the medium can be conveyed in the state of being favorably sandwiched by intermediate roller pair.

(E) In the printing apparatus, the second pressing load is 10% or less of the first pressing load.

(F) In the printing apparatus, the conveyance unit includes a second driving unit configured to drive the second driving roller, and the control unit is configured to execute an intermediate adjustment operation and a feed adjustment operation, the intermediate adjustment operation being configured to adjust tension of the medium located between the conveyance roller pair and the intermediate roller pair by controlling the second driving unit so as to rotate the second driving roller, the feed adjustment operation being configured to adjust the tension of the medium located between the intermediate roller pair and the feeding unit by controlling the feeding unit.

With this configuration, the control unit can execute the intermediate adjustment operation that adjusts the tension of the medium located between the conveyance roller pair and the intermediate roller pair by controlling the second driving unit so as to rotate the second driving roller. Thus, conveyance errors caused in the medium located between the conveyance roller pair and the intermediate roller pair during the conveyance of the medium can be eliminated through the intermediate adjustment operation. The control unit can execute the feed adjustment operation that adjusts the tension of the medium located between the intermediate roller pair and the feeding unit by controlling the feeding unit. Thus, conveyance errors caused in the medium located between the intermediate roller pair and the feeding unit during the conveyance of the medium can be eliminated through the feed adjustment operation. Thus, the conveyance of the medium with the conveyance roller pair can be performed with high accuracy.

(G) In the printing apparatus, the conveyance unit includes a second driving unit configured to drive the second driving roller, and the control unit is configured to execute an intermediate adjustment operation and a slack formation operation, the intermediate adjustment operation being configured to adjust tension of the medium located between the conveyance roller pair and the intermediate roller pair by controlling the second driving unit so as to rotate the second driving roller, the slack formation operation being configured to form slack in the medium located between the intermediate roller pair and the feeding unit by controlling the feeding unit so as to feed the medium from the roll toward the conveyance roller pair.

With this configuration, the control unit can execute the intermediate adjustment operation that adjusts the tension of the medium located between the conveyance roller pair and the intermediate roller pair by controlling the second driving unit so as to rotate the second driving roller. Thus, conveyance errors caused in the medium located between the conveyance roller pair and the intermediate roller pair during the conveyance of the medium can be eliminated through the intermediate adjustment operation. The control unit can execute the slack formation operation that forms slack in the medium located between the intermediate roller pair and the feeding unit by controlling the feeding unit so as to feed the medium from the roll toward the conveyance roller pair. Thus, the intermediate roller pair is less affected by the eccentricity, tilt, and the like of the roll. As a result, reduction in conveyance accuracy at the intermediate roller pair, and in turn, reduction in conveyance accuracy at the conveyance roller pair can be suppressed. Thus, the conveyance of the medium with the conveyance roller pair can be performed with high accuracy.

(H) In the printing apparatus, the conveyance unit includes a second driving unit configured to drive the second driving roller, and the control unit executes the first control after the second control is executed when the rotation of the first driving roller is stopped in the intermittent conveyance, and executes an intermediate slack elimination operation after the first control is executed when the rotation of the first driving roller is stopped in the intermittent conveyance, the intermediate slack elimination operation being configured to eliminate slack of the medium located between the conveyance roller pair and the intermediate roller pair by controlling the second driving unit so as to rotate the second driving roller in a direction opposite to a direction of conveying the medium toward the conveyance roller pair.

With this configuration, the control unit executes the intermediate slack elimination operation that controls the second driving unit so as to rotate the second driving roller in the direction opposite to the direction of conveying the medium toward the conveyance roller pair. The slack of the medium located between the conveyance roller pair and the intermediate roller pair is eliminated through the intermediate slack elimination operation. Thus, for the medium located between the conveyance roller pair and the intermediate roller pair, the accumulated conveyance errors in the width direction and the accumulated errors of the slack amount can be reset.

(I) A conveyance control method of conveying a medium with a conveyance unit, in which the conveyance unit includes a feeding unit configured to feed the medium from a roll wound with the medium in a rolled form, a conveyance roller pair configured to convey the medium fed by the feeding unit, and an intermediate roller pair configured to convey, toward the conveyance roller pair, the medium fed by the feeding unit at a position between the feeding unit and the conveyance roller pair, the conveyance roller pair includes a first driving roller, and a first driven roller configured to sandwich the medium together with the first driving roller, the intermediate roller pair includes a second driving roller, and a second driven roller configured to sandwich the medium together with the second driving roller, the conveyance unit includes a first driving unit configured to rotate the first driving roller, and a load changing unit configured to change a pressing load acting between the second driving roller and the second driven roller. The method includes controlling the first driving unit such that the first driving roller is rotated and stopped in an alternate manner in an intermittent conveyance of conveying and stopping the medium in an alternate manner, executing a first control configured to control the load changing unit such that the pressing load is a first pressing load when the first driving roller is rotated in the intermittent conveyance, and executing a second control configured to control the load changing unit such that the pressing load is not generated or that the pressing load is a second pressing load smaller than the first pressing load when rotation of the first driving roller is stopped in the intermittent conveyance.

With this method, the second control that controls the load changing unit such that the pressing load is not generated or that the pressing load is the second pressing load smaller than the first pressing load when the rotation of the first driving roller is stopped in the intermittent conveyance is executed. Thus, the load that acts on the medium from the intermediate roller pair at the execution of the second control is smaller than at the execution of the first control. Thus, wrinkles formed in the medium in the vicinity of the conveyance area of the intermediate roller pair can be eliminated.

What is claimed is:

1. A printing apparatus comprising:

a printing unit configured to perform printing on a medium;

a conveyance unit configured to convey the medium to the printing unit; and a control unit configured to control the conveyance unit, wherein the conveyance unit includes:

a feeding unit configured to feed the medium from a roll wound with the medium in a rolled form, a conveyance roller pair configured to convey, toward the printing unit, the medium fed by the feeding unit, and an intermediate roller pair configured to convey, toward the conveyance roller pair, the medium fed by the feeding unit at a position between the feeding unit and the conveyance roller pair, the conveyance roller pair includes:

a first driving roller and a first driven roller configured to sandwich the medium together with the first driving roller, the intermediate roller pair includes:

a second driving roller and a second driven roller configured to sandwich the medium together with the second driving roller, the conveyance unit includes:

a first driving unit configured to rotate the first driving roller and a load changing unit configured to change a pressing load acting between the second driving roller and the second driven roller by changing a distance between a rotation shaft of the second driven roller and a rotation shaft of the second driving roller, and the control unit is configured to:

control the first driving unit such that the first driving roller is rotated and stopped in an alternate manner in an intermittent conveyance of conveying and stopping the medium in an alternate manner, execute a first control configured to control the load changing unit by changing the distance between a rotation shaft of the second driven roller and a rotation shaft of the second driving roller such that the pressing load is a first pressing load when the first driving roller is rotated in the intermittent conveyance, and execute a second control configured to control the load changing unit by changing the distance between a rotation shaft of the second driven roller and a rotation shaft of the second driving roller such that the pressing load is not generated or such that the pressing load is a second pressing load smaller than the first pressing load when rotation of the first driving roller is stopped in the intermittent conveyance.

2. The printing apparatus according to claim 1, wherein the control unit executes the second control each time rotation of the conveyance roller pair is stopped.

3. The printing apparatus according to claim 1, wherein the control unit executes the second control each time rotation of the conveyance roller pair is stopped multiple times.

4. The printing apparatus according to claim 1, wherein the control unit executes the first control after the second control is executed when the rotation of the first driving roller is stopped in the intermittent conveyance.

5. The printing apparatus according to claim 1, wherein the second pressing load is 10% or less of the first pressing load.

6. The printing apparatus according to claim 1, wherein the conveyance unit includes a second driving unit configured to drive the second driving roller and the control unit is configured to execute an intermediate adjustment operation and a feed adjustment operation, the intermediate adjustment operation being configured to adjust tension of the medium located between the conveyance roller pair and the intermediate roller pair by controlling the second driving unit so as to rotate the second driving roller, the feed adjustment operation being configured to adjust the tension of the medium located between the intermediate roller pair and the feeding unit by controlling the feeding unit.

7. The printing apparatus according to claim 1, wherein the conveyance unit includes a second driving unit configured to drive the second driving roller and the control unit is configured to execute an intermediate adjustment operation and a slack formation operation, the intermediate adjustment operation being configured to adjust tension of the medium located between the conveyance roller pair and the intermediate roller pair by controlling the second driving unit so as to rotate the second driving roller, the slack formation operation being configured to form slack in the medium located between the intermediate roller pair and the feeding unit by controlling the feeding unit so as to feed the medium from the roll toward the conveyance roller pair.

8. The printing apparatus according to claim 1, wherein the conveyance unit includes a second driving unit configured to drive the second driving roller and the control unit executes the first control after the second control is executed when the rotation of the first driving roller is stopped in the intermittent conveyance and executes an intermediate slack elimination operation after the first control is executed when the rotation of the first driving roller is stopped in the intermittent conveyance, the intermediate slack elimination operation being configured to eliminate slack of the medium located between the conveyance roller pair and the intermediate roller pair by controlling the second driving unit so as to rotate the second driving roller in a direction opposite to a direction of conveying the medium toward the conveyance roller pair.

9. The printing apparatus according to claim 1, wherein the load changing unit includes a rack and pinion mechanism, the second driven roller is supported by a rack of the rack and pinion mechanism, and the rack and pinion mechanism changes the distance.

10. The printing apparatus according to claim 1, the conveyance unit configured to convey the medium to the printing unit.

11. A conveyance control method of conveying a medium with a conveyance unit, the conveyance unit including:

a feeding unit configured to feed the medium from a roll wound with the medium in a rolled form, a conveyance roller pair configured to convey the medium fed by the feeding unit, and an intermediate roller pair configured to convey, toward the conveyance roller pair, the medium fed by the feeding unit at a position between the feeding unit and the conveyance roller pair, the conveyance roller pair including:

a first driving roller and a first driven roller configured to sandwich the medium together with the first driving roller, the intermediate roller pair including:

a second driving roller and a second driven roller configured to sandwich the medium together with the second driving roller, the conveyance unit including:

a first driving unit configured to rotate the first driving roller and a load changing unit configured to change a pressing load acting between the second driving roller and the second driven roller by relative translational movement of the rotation shaft of the second driven roller with respect to the rotation shaft of the second driving roller, the method comprising:

controlling the first driving unit such that the first driving roller is rotated and stopped in an alternate manner in an intermittent conveyance of conveying and stopping the medium in an alternate manner;

executing a first control configured to control the load changing unit by changing a distance between a rotation shaft of the second driven roller and a rotation shaft of the second driving roller such that the pressing load is a first pressing load when the first driving roller is rotated in the intermittent conveyance; and executing a second control configured to control the load changing unit by changing the distance between a rotation shaft of the second driven roller and a rotation shaft of the second driving roller such that the pressing load is not generated or such that the pressing load is a second pressing load smaller than the first pressing load when rotation of the first driving roller is stopped in the intermittent conveyance.

12. The conveyance control method according to claim 11, the conveyance roller pair configured to convey the medium fed by the feeding unit without cutting the medium.

13. A printing apparatus comprising:

a printing unit configured to perform printing on a medium;

a conveyance unit configured to convey the medium to the printing unit; and a control unit configured to control the conveyance unit, wherein the conveyance unit includes:

a feeding unit configured to feed the medium from a roll wound with the medium in a rolled form, a conveyance roller pair configured to convey, toward the printing unit, the medium fed by the feeding unit, and an intermediate roller pair configured to convey, toward the conveyance roller pair, the medium fed by the feeding unit at a position between the feeding unit and the conveyance roller pair, the conveyance roller pair includes:

a first driving roller and a first driven roller configured to sandwich the medium together with the first driving roller, the intermediate roller pair includes:

a second driving roller and a second driven roller configured to sandwich the medium together with the second driving roller, the conveyance unit includes:

a first driving unit configured to rotate the first driving roller, a second driving unit configured to rotate the second driving roller and a load changing unit configured to change a pressing load acting between the second driving roller and the second driven roller, and the control unit is configured to:

control the first driving unit such that the first driving roller is rotated and stopped in an alternate manner in an intermittent conveyance of conveying and stopping the medium in an alternate manner, control the second driving unit such that the second driving roller is rotated and stopped, execute a first control configured to control the load changing unit such that the pressing load is a first pressing load when the first driving roller is rotated in the intermittent conveyance, execute a second control configured to control the load changing unit such that the pressing load is not generated or such that the pressing load is a second pressing load smaller than the first pressing load when rotation of the first driving roller is stopped in the intermittent conveyance, and control the load changing unit such that the pressing load is the first pressing load when the first driving roller is stopped and the second driving roller is rotated.

14. The printing apparatus according to claim 13, wherein the control unit controls the load changing unit such that the pressing load is the first pressing load when the first driving roller is stopped and the feeding unit is rotated.

15. The printing apparatus according to claim 14, wherein the control unit is configured to execute a slack formation operation, the slack formation operation being configured to form slack in the medium located between the intermediate roller pair and the feeding unit by controlling the feeding unit so as to feed the medium from the roll toward the conveyance roller pair, and the control unit controls the load changing unit such that the pressing load is the first pressing load when the slack formation operation is executed.

16. The printing apparatus according to claim 14, wherein the control unit is configured to execute a feed slack elimination operation, the feed slack elimination operation being configured to eliminate slack of the medium located between the intermediate roller pair and the feeding unit by controlling the feeding unit so as to rotate the feeding unit in a direction opposite to a direction of feeding the medium from the roll toward the conveyance roller pair, and the control unit controls the load changing unit such that the pressing load is the first pressing load when the feed slack formation operation is executed.

* * * * *